US005271793A

United States Patent [19]

Seifert et al.

[11] Patent Number: 5,271,793

[45] Date of Patent: Dec. 21, 1993

[54] APPARATUS FOR TRANSPORTING CONTAINERS IN LABELLING MACHINES

[75] Inventors: Günter Seifert, Burg; Gerd-Reiner Israel, Dresden, both of Fed. Rep. of Germany

[73] Assignee: Alfill Getranketechnik GmbH, Hamburg, Fed. Rep. of Germany

[21] Appl. No.: 990,671

[22] Filed: Dec. 14, 1992

[30] Foreign Application Priority Data

Dec. 14, 1991 [DE] Fed. Rep. of Germany ..... 4141284

[51] Int. Cl.[5] ..... B65C 9/00

[52] U.S. Cl. ..... 156/566; 156/447; 156/458; 156/567; 156/573; 156/DIG. 26

[58] Field of Search ..... 156/447, 458, 556, 566, 156/567, 570, DIG. 26, DIG. 27, 573

[56] References Cited

U.S. PATENT DOCUMENTS 3,802,942 4/1974 Amberg et al. ..... 156/458 X
4,430,141 2/1984 Zodrow ..... 156/DIG. 27 X
4,531,995 7/1985 Gau ..... 156/DIG. 26 X

FOREIGN PATENT DOCUMENTS 3307662 7/1986 Fed. Rep. of Germany .

*Primary Examiner*—David A. Simmons
*Assistant Examiner*—James J. Engel, Jr.
*Attorney, Agent, or Firm*—Darby & Darby

[57] ABSTRACT

Apparatus for transporting containers having circular portions with any one of a number of different diameters first along an adhesive applying unit and thereupon past one or more units which apply labels all the way around the circular portions of the containers has a rotary turntable with a set of depending rotary supporting elements for discrete containers. The supporting elements are rotated about their own axes, while orbiting about the axis of rotation of the turntable, by two arcuate cams which are adjacent the path of orbital movement of the supporting elements and are tracked by roller followers provided on disc-shaped holders at the upper ends of the supporting elements. Adjustment of the apparatus for the transport of containers having circular portions of different diameters is effected by moving the cams in the circumferential direction of the turntable. The positions of the various treating units remain unchanged.

13 Claims, 3 Drawing Sheets

APPARATUS FOR TRANSPORTING CONTAINERS IN LABELLING MACHINES

BACKGROUND OF THE INVENTION

The invention relates to improvements in machines for multiple treatment of containers, and more particularly to improvements in apparatus for transporting containers in such machines. Still more particularly, the invention relates to improvements in apparatus for transporting containers (such as bottles or cans) which include circular portions, i.e., containers which can constitute, or certain portions of which constitute, hollow cylinders. Still more particularly, the invention relates to apparatus which can be utilized to transport containers having circular portions in machines for the application of labels to such circular portions, especially for the application of labels having a size and shape such that they can form circumferentially complete bands around the circular portions of the treated containers.

It is known to transport containers of the above outlined character in a machine wherein the containers are provided with labels extending all the way around the circular portions of successive containers. Machines of such character are provided (a) with pasters which partially coat the circular portions of successive containers of a short or long series of identical containers with a suitable adhesive, and (b) with label dispensers which supply labels to successive adhesive-coated containers while the containers rotate about their respective axes.

Problems arise when one and the same machine is intended for the application of labels to containers having circular portions of different diameters. A changeover from the treatment of containers having smaller-diameter circular portions to the treatment of containers having larger-diameter circular portions or vice versa takes up much time and contributes significantly to complexity of the container transporting apparatus. This also holds true for containers wherein the adjusting mechanism employs sets of arcuate cams and followers which track the cams and serve to rotate the supports for discrete containers. On the other hand, it is important and desirable to equip a modern container filling, labelling and sealing machine or production line with transporting apparatus which can convey containers of different sizes with the same degree of accuracy and reproducibility and which need not be arrested for long intervals of time in order to change the setup, i.e., to adjust the machine for the treatment of containers having circular portions with diameters departing from those of the previously treated containers.

OBJECTS OF THE INVENTION

An object of the invention is to provide a machine for the treatment of containers having circular portions with an apparatus which can transport containers having circular portions of different sizes and which can rapidly shift from the transport of containers having circular portions of a first diameter to the transport of containers having circular portions of a larger or smaller second diameter.

Another object of the invention is to provide a container transporting apparatus which can be utilized with particular advantage in machines for the application of labels all the way around circular portions of the containers.

A further object of the invention is to provide the transporting apparatus with novel and improved means for adjusting its parts for proper transport of containers having circular portions of a first size subsequent to completion of treatment of a long or short series of containers having circular portions of a different second size.

An additional object of the invention is to provide the apparatus with novel and improved means for selecting the speed of rotation of containers about their own axes during transport through a plurality of successive treating stations.

Still another object of the invention is to enhance the versatility of machines for the application of labels to containers having circular label-receiving portions.

A further object of the invention is to provide novel and improved cams for use in the above outlined apparatus.

Another object of the invention is to provide an apparatus wherein the positions of the container treating units can remain unchanged irrespective of the diameters of circular portions of the treated containers.

An additional object of the invention is to provide an apparatus which can be used for the transport of a variety of containers including bottles, cans, jars and/or any other containers having circular portions or constituting cylindrical bodies.

Still another object of the invention is to provide a machine which embodies the above outlined transporting apparatus.

A further object of the invention is to provide a simple, compact and inexpensive apparatus which can be installed in existing labelling machines for cans, bottles, jars and similar containers.

SUMMARY OF THE INVENTION

The invention is embodied in a machine for multiple treatment of containers having circular portions with different diameters, and more particularly in an apparatus for transporting containers in such machine. The improved apparatus comprises a carrier (such as a turntable) which is turnable about a first axis (preferably a vertical axis), means for turning the carrier about the first axis in a first direction and preferably at a variable speed, a succession of container supporting elements which are mounted on the carrier for orbital movement about the first axis along a predetermined path (each supporting element is turnable about a discrete second axis which is preferably parallel to the first axis), means for treating successive containers at a first portion of the predetermined path, means for treating successive containers at a second portion of the predetermined path at a predetermined distance from and downstream of the first portion, means for rotating the supporting elements about the respective second axes in a second direction counter to the first direction including first and second cams adjacent the predetermined path and first and second followers provided on each of the supporting elements and respectively tracking the first and second cams, and means for adjusting the cams relative to the predetermined path as a function of the diameters of circular portions of containers which are supported by the supporting elements including means for moving the cams along the predetermined path.

The cams are preferably provided with toothed cam faces and are offset relative to each other in the first direction. The cam faces preferably have a series of identical sections in the direction of the predetermined path, and each section of each cam face extends between two spaced-apart points of the respective cam face. The adjusting means of such transporting apparatus can comprise means for moving the cams between an infinite number of different positions through a predetermined angle in and counter to the first direction.

The treating means at the first portion of the predetermined path can comprise means for applying an adhesive to circular portions of successive containers in the predetermined path, and the treating means at the second portion of the predetermined path can comprise means for applying labels to adhesive-coated circular portions of successive containers in the predetermined path.

The carrier can comprise means for maintaining the supporting elements in suspended positions, and the cams can be disposed at a level above the supporting elements. Each such cam can have an arcuate shape with a center of curvature on the first axis.

The rotating means can further comprise a holder on each supporting element, and the followers are then provided on the respective holders. The aforementioned points of the cam faces are positioned to maintain the holders in predetermined angular positions relative to the respective second axes in each position of the cams relative to the predetermined path when the holders reach the aforementioned first and second portions of the predetermined path.

The aforementioned points preferably correspond to predetermined rotational speeds of the supporting elements about the respective second axes in dependency on the diameters of circular portions of the containers which are supported by the supporting elements so that the radially outermost portion of a container advancing past the first and second portions of the predetermined path is at a standstill in a predetermined angular position of a holder for the followers on the corresponding supporting element.

As mentioned above, the rotating means can comprise holders which are rotatable with the supporting elements about the respective second axes and support the corresponding followers, and each of these holders advances along an entire velocity spectrum for at least one of the cams between the maximum and minimum diameters of the containers intermediate the first and second portions of the predetermined path in each position of adjustment of the cams.

The aforementioned predetermined distance is selected in such a way that it suffices to permit each supporting element and the followers on the supporting element to turn through an angle of 360° about the respective second axis between the first and second portions of the predetermined path irrespective of the adjustment of the two cams in dependency on the diameters of circular portions of containers which are supported by (e.g., suspended from) the supporting elements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
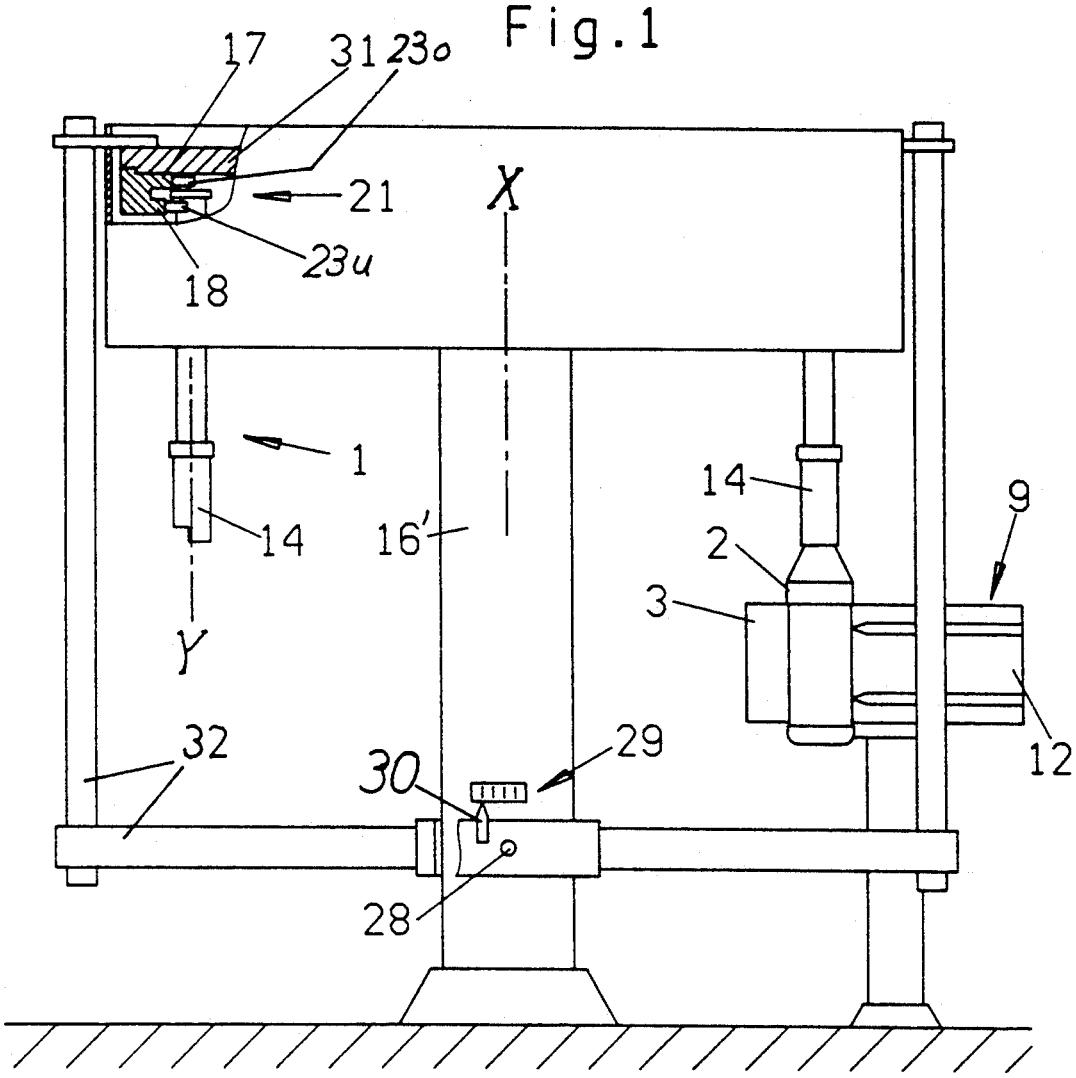
FIG. 1 is a schematic elevational view of an apparatus which embodies one form of the invention and is installed in a machine for labelling cans, bottles or analogous containers having circular portions, a portion of the apparatus being broken away and several supporting elements being omitted.

Referring first to FIG. there is shown a transporting apparatus for containers 2 of the type having circular portions. The containers 2 which are shown in the drawings are cylindrical cans of metallic or plastic material; however, it is equally possible to treat containers in the form of bottles each having a circular cylindrical or similar portion for the application of a label 3 which is dimensioned to completely surround the selected circular portion of the respective container. It is assumed that the containers 2 which are shown in the drawing are made of a plastic material, such as PET, and that each such container is to be provided with a label 3 which, when properly applied, forms a hollow cylinder extending along an arc of 360° all the way around the circumference of the respective container 2.

Figure 2:
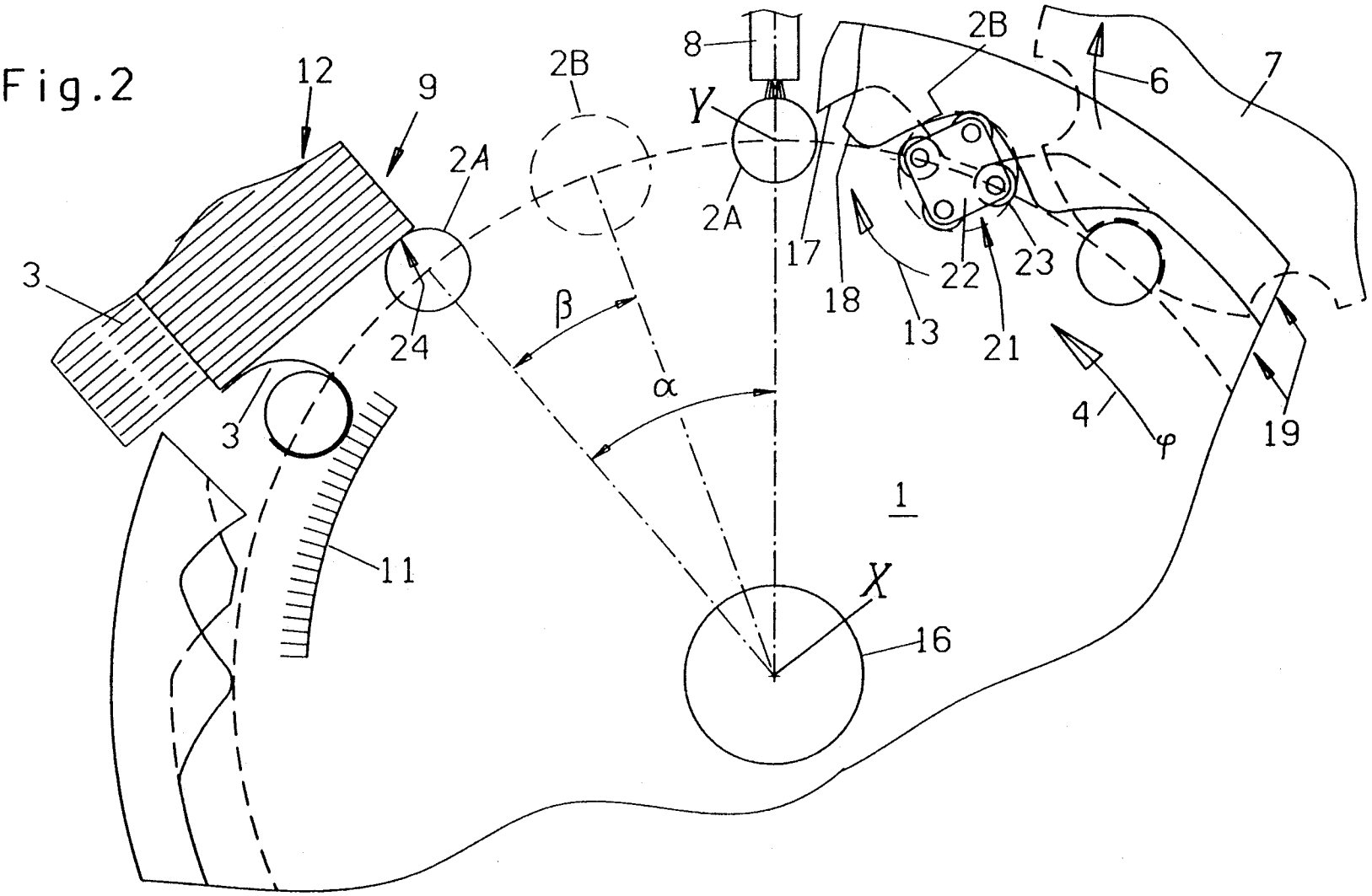
FIG. 2 is an enlarged fragmentary plan view of the apparatus and of its adhesive applying and label supplying units.
Figure 3:
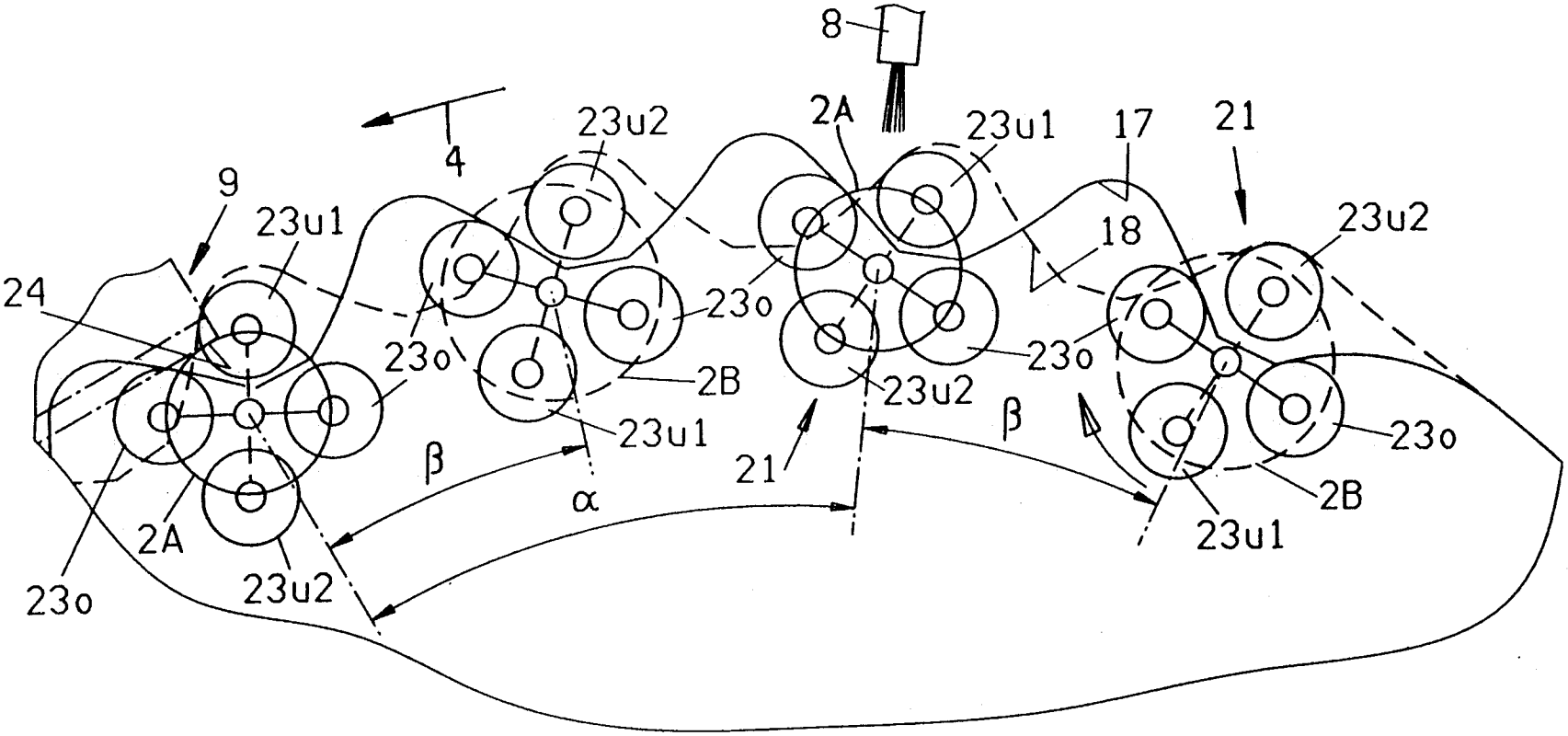
FIG. 3 is an enlarged plan view of portions of the cams and other component parts of the means for transporting containers past the two treating units.

A carrier in the form of a turntable is rotatable in the direction of arrow 4 (FIGS. 2 and 3) and carries an annulus of supporting elements 14 each of which can temporarily support, in suspended position, a container 2 for orbital movement along a circular path about a vertical axis X (which is the axis of rotation of the carrier 1). The means for supplying containers 2 into the range of successive supporting elements 14 comprises a turnstile type conveyor 7 which is driven in the direction of arrow 6 in synchronism with the carrier 1. A supporting element 14 which has accepted a container 2 from the conveyor 7 transports the container along the aforementioned circular path, first along a treating unit 8, thereupon along a treating unit 9, and thereupon into the range of a second turnstile type conveyor (not shown) which is driven in synchronism with the carrier and serves to accept successive treated containers 2, e.g., for delivery to a conveyor which transports the containers to storage, to a packing station or to any other destination. The first treating unit 8 is a paster which serves to apply a suitable adhesive to those portions of peripheral surfaces of successive containers 2 which are to be surrounded by labels 3. FIGS. 2 and 3 merely show a nozzle which is located at the station for the paster 8 and is designed to discharge a vertical spray of adhesive against the adjacent container 2 while the latter is held against rotation or turns about its own axis, namely about the axis Y of the respective supporting element 14. The axes Y of the supporting elements 14 are parallel to the axis X of rotation of the carrier 1.

The treating unit 9 includes at least one magazine or another suitable source of labels 3. FIG. 2 shows that the magazine of the treating unit 9 contains a stack 12 of superimposed labels 3. This magazine can be designed to store labels of different sizes or it can be replaced with one or more magazines for labels having different sizes. FIG. 2 shows, by broken lines, a stack of labels 3' which are longer than the labels 3 and, therefore, are intended for the application to circular portions of larger-diameter containers. The labels 3 are withdrawn from that end of the stack 12 which is immediately adjacent the path of orbital movement of the containers 2, and such withdrawal is effected by the containers themselves in a manner as shown in FIG. 2, i.e., each container moves with the carrier 1 about the axis X and simultaneously turns about its own axis Y in the direction of arrow 13 (namely counter to the direction of orbital movement as indicated by the arrow 4) to "peel" the immediately adjacent label 3 off the neighboring label in the stack 12.

Even before the application of a label 3 around the respective container 2 is completed, such container advances past a brushing or smoothing unit whose bristles ensure highly predictable application of successive labels 3, i.e., free of wrinkles and in such a way that each applied label constitutes a cylinder which completely surrounds the selected circular portion of the respective container.

The treating units 8 and 9 are installed at a fixed angular distance alpha from each other and need not be adjusted in or counter to the direction of arrow 4. Any adjustments which must be carried out if the containers 2 are followed by containers having larger-diameter or smaller-diameter circular portions is in the radial direction of the path for the supporting elements 14, i.e., in a direction toward or away from the axis X of the carrier 1. As can be seen in FIG. 2, the radially innermost label 3' is located radially outwardly of the innermost label 3 in the stack 12 because the stack of labels 3' must be positioned at a greater radial distance from the axis X in order to provide room for larger-diameter containers 2 which are to be partially coated with adhesive during advancement past the treating unit 8 and are to be thereupon provided with labels 3' during advancement along the treating unit 9. The magnitude of the angle alpha is selected in such a way that it suffices to ensure that any container advancing from the nozzle of the unit 8 to the location (indicated in FIG. 2 by an arrow 24) of initial contact with a label 3 or 3' can complete a full revolution (in the direction of arrow 13), i.e., that it can turn through an angle of 360° about the axis Y of the respective supporting element 14. In other words, the angle alpha suffices to ensure that a container can turn through 360°, regardless of its diameter, on its way from the treating unit 8 to the treating unit 9.

For the sake of convenience and clarity, FIGS. 2 and 3 illustrate smaller-diameter containers 2A which alternate with larger-diameter containers B. It will be appreciated that, in actual practice, a series of successive containers having identical diameters will be treated before the machine embodying the improved apparatus is adjusted and set up for the treatment of containers with circular portions having larger or smaller diameters. The term "diameter" is intended to refer to the dimensions of those portions of the containers 2A or 2B which have a circular outline and are to be surrounded by labels 3 or 3' or by labels of any other suitable size.

The supporting elements 14 are preferably equidistant from each other in the circumferential direction of the carrier 1 and are provided with means for maintaining containers 2A, 2B or containers having other diameters in suspended position. The means for rotating the carrier 1 in the direction of arrow 4 about the axis X includes an upright shaft 16 which can be driven at any one of a plurality of different speeds, e.g., at an infinitely variable speed, by a driving mechanism not forming part of the present invention.

The means for rotating the supporting elements 14, and the containers 2A or 2B which are carried by such elements, in the direction of arrow 13 (i.e., counter to the direction of rotation of the carrier 1) is constructed and assembled and can be adjusted (to permit the treatment of containers having different diameters) in accordance with a feature of the present invention. Such rotating means comprises a first cam 17 and a second cam 18 both adjacent the path of movement of cans 2 with the respective supporting elements 14, and sets of followers 23 which are mounted on each supporting element 14 and track the cams 17, 18 in response to rotation of the carrier 1 about the axis X. The cams 17 and 18 have tooth-shaped protuberances or lobes which are offset by 180° relative to each other (as seen in the direction of the arrow 4), and these cams are provided on or form part of a two-story support 19 (hereinafter called frame) serving to facilitate simultaneous adjustment of the two cams in or counter to the direction of arrow 4. The means for rotating the supporting elements 14 about the respective axes Y further comprises discrete holders 21 which are turnable about the corresponding axes Y and each of which rotatably mounts a set of roller followers 23*u* as well as a set of roller followers 23*o*. Each holder 21 includes or constitutes a disc 22 which supports the vertical shafts of two roller followers 23*o* and two roller followers 23*u*. The roller followers 23*u* are disposed diametrically opposite each other with respect to the corresponding axis Y (note the followers 23*u*1 and 23*u*2) and serves to track the toothed face of the lower cam 18, and the roller followers 23*o* are also disposed diametrically opposite each other and serve to track the toothed face of the upper cam 17. The roller followers 23*u* alternate with the roller followers 23*o* in the circumferential direction of the respective disc 22, and the angular distance between each pair of neighboring roller followers on a disc 22 is 90°. Each disc 22 is affixed to the upper end of the respective supporting element 14. The distance of each of the four roller followers 23*u*, 23*o* on any of the discs 22 from the respective axis Y is the same. The roller followers 23*o* are installed at the upper sides and the roller followers 23*u* are disposed at the undersides of the respective discs 22.

The cams 17 and 18 have arcuate shapes with centers of curvature on the axis X of the carrier 1. Each of these cams is provided with a single program for rotation of the supporting elements 14. In order to ensure that each of the elements 14 will be rotated about its axis Y at an optimal speed for the diameter of the respective container 2, the two cams are infinitely adjustable, with their frame 19, in or counter to the direction of arrow 4 within an angle beta which is smaller than the angle alpha and extends from the location 24 at the path portion next to the treating unit 9 toward but short of the path portion next to the treating unit 8. The arrangement is such that, for each contemplated diameter (i.e., for each of a range of containers having diameters anywhere between a maximum and a minimum diameter the maximum adjustment of the frame 19 in or counter to the direction of the arrow 4 is indicated by the angle beta. Otherwise stated, for any selected diameter identical points B and $B_1$ or A and $A_1$ of corresponding cam face sections (indicated by hatching in FIG. 4) are effective for a particular angular velocity omega at the station for the treating unit 8 and at the location 24 where the withdrawal of a label 3 or 3' at the station for the treating unit 9 begins.

Figure 4:
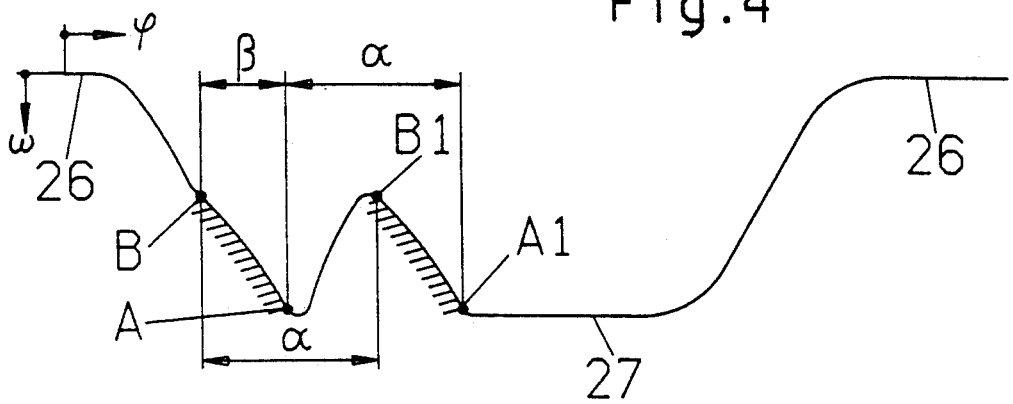
FIG. 4 is a diagram showing the variations of speeds for the transport of containers, having larger or smaller circular portions, past the treating units.

The character gamma denotes in FIG. 4 the extent of angular displacement of the carrier 1 about the axis X, and the character omega denotes the angular velocity of the containers 2 about the respective axes Y during advancement of such containers past the treating units 8 and 9. The numerals 26 denote the path portions where the rotational speed of the containers about the respective axes varies, and the numeral 27 denotes the path portion wherein the rotational speed of the containers 2 about the respective axes Y is constant to ensure satisfactory application of labels 3 or 3' around the previously partially coated circular portions of the containers during advancement past the brushing unit 11. As already mentioned before, the angle beta denotes the maximum extent of adjustment of the cams 17, 18, in or counter to the direction of arrow 4. The points B and $B_1$ are spaced apart an angular distance denoted by the angle alpha and denote the speed omega for containers 2 having circular portions of maximum diameter. The points A and $A_1$ denote angular velocities omega for containers having minimum-diameter circular portions. Any of the points between those indicated by B and A and those indicated by $B_1$ and $A_1$ are for containers having circular portions with diameters somewhere between the maximum and minimum diameters. The slopes of the sections of the curve between the points B–A and $B_1$–$A_1$ are indicative of the angular velocities omega for containers having circular portions with diameters between the maximum and minimum diameters.

FIG. 3 shows the positions of the holders 21 for alternating smaller-diameter containers 2A and larger-diameter containers 2B. As already mentioned before, the roller followers 23*u* (denoted in FIG. 3 by the characters 23*u*l and 23*u*2) track the lower cam 18, and the roller followers 23*o* track the upper cam 17 in the frame 19. FIG. 3 further shows that the angular positions of the holders 21 for the supporting elements 14 and cans 2A at the stations for the treating units 8 and 9 are identical. Thus, the holder 21 which is shown at the station for the treating unit 8 completes a full revolution about the respective axis Y before it reaches the location 24 at the station for the treating unit 9. Thus, that strip of the circular portion of a minimum-diameter container 2A at the station for the treating unit 8 which is in the process of being coated with adhesive is located at the point 24 when the step of convoluting a label 3 therearound begins at the station for the treating unit 9. The circular portion of the minimum-diameter container 2A at the location 24 begins to remove a label 3 in that it rolls along the underside of the next-higher label 3 in the stack 12, i.e., the container 2A at the station for the unit 9 does not slide along the label 3 which is being convoluted around its circular portion as a result of rotation of the carrier 1 about the axis X. This is ensured by the then effective portions of cam faces of the cams 17 and 18 whose angular positions are selected with a view to take into consideration the fact that the diameters of circular portions of the containers 2A are the smallest diameters of the acceptable range of diameters for the application of cylindrical labels to containers in the apparatus of the present invention. Proper selection of angular positions of the cams 17, 18 in dependency on the diameters of containers 2A ensures that the angular velocity omega of containers 2A causes these containers to advance along the unit 8 and at the point 24 at zero peripheral speed relative to the stationary units 8 and 9. The same holds true for containers 2B having maximum diameters as well as for containers having diameters anywhere between that of a container 2A and that of a container 2B. The aforementioned single rotational program of the cams 17, 18 is determined by the (maximum) diameter of a container 2B and the (minimum) diameter of a container 2A. Such single program is complete in each selected position of the frame 19 for the cams 17, 18 within the angular distance which is denoted by the angle alpha, i.e., between the stations for the treating units 8 and 9. In other words, the entire program is utilized irrespective of the speed of a container 2 about the respective axis Y during advancement past the treating units 8 and 9. The relevant points of the curve which is shown in FIG. 4 are effective for each selected diameter when a container having such selected diameter is being transported past the treating unit 8 and thereupon past the location 24 next to the treating unit 9.

The means for simultaneously adjusting the cams 17, 18 (i.e., for adjusting the frame 19 for these cams) includes a carriage 32 which is adjustably affixed to a sleeve 16' for the shaft 16 by one or more fasteners 28 or in any other suitable way. A pointer 30 on the carriage 32 and a stationary scale 29 on the sleeve 16' facilitate proper selection of the angular position of the frame 19 and its cams 17, 18 in dependency on the diameters of containers 2 which are to be labelled during advancement by the improved apparatus. The maximum range of adjustments is denoted by the angle beta. The carriage 32 includes a plate-like portion 31 which is disposed at a level above the elements 14 and supports the frame 19 for the cams 17 and 18. The adjustments of cams 17, 18 need not be shared by the treating units 8 and 9, i.e., the positions of these treating units (as considered in the direction of arrow 4) remain unchanged. The only adjustments which might be needed are those in directions radially of the axis X in order to move the nozzle of the treating unit 8 to an optimum position relative to containers having a given diameter and to move a selected magazine or a stack of properly dimensioned labels to an optimum position for withdrawal of successive innermost labels by successive oncoming containers 2.

It is clear that the positions of the pointer 30 and the scale 29 can be reversed. Furthermore, the adjusting means for the cams 17, 18 can be constructed in a manner departing from the construction of the adjusting means 28–32 shown in FIG. 1, as long as it can select the angular positions of the cams in dependency on the diameters of the containers which are about to be provided with strips of adhesive and thereupon with labels during transport past the stations for the treating units 8 and 9.

German Pat. No. 33 07 662 granted Jul. 3, 1986 to Gau for "Labelling machine for containers" discloses an apparatus which employs two cams and a rotary carrier for a set of supporting elements which are rotatable about discrete axes while orbiting along a circular path. The difference between the apparatus of Gau and the apparatus of the present invention is that Gau proposes to employ fixedly mounted cams and to adjust the apparatus for the treatment of containers having circular portions with different diameters by providing a labelling unit which must be moved in or counter to the direction of orbital movement of the supporting elements. A drawback of the patented apparatus is that it is much more difficult to properly adjust an entire label applicator than two cams. Moreover, the patented apparatus must employ complex cams which have differently profiled cam face sections to permit the application of labels to containers having circular portions of different diameters.

An important advantage of the improved apparatus is that containers having larger, medium-sized or small circular portions can be transported with the same degree of accuracy during advancement past the treating units. This holds true for the transport of a practically infinite number of containers having circular portions of different diameters, as long as the diameters are within a selected range of diameters.

Another important advantage of the improved apparatus is that it can be rapidly and repeatedly converted for the treatment of containers having circular portions of a particular diameter. When the adjustment is completed, the apparatus can advance a long or a short series of successive containers with circular portions having a particular diameter in such a way that the angular position of a container which has already advanced beyond the first treating unit 8 is best suited for the treatment at the next-following station or stations, such as for reception of a label on arrival at the location 24 of the arcuate path which is defined by the carrier 1 and its supporting elements 14. The treating unit 8 need not apply adhesive to the entire external surface of a circular portion of the container advancing from the conveyor 6 toward the treating unit 9. Proper orientation of containers at the stations for the treating units 8 and 9 is of particular importance because the illustrated unit 8 is designed to apply a film of adhesive to a rather narrow strip of the external surface of the circular portion of a container arriving at the station for the unit 8 because it is then even more important to ensure that the application of a label begins at the location where the external surface of the adjacent container is provided with a strip of adhesive and that the application of the label can end at the location which carries an adhesive film. The attachment of trailing ends of labels 3 or 3' to the respective containers can be carried out downstream of the brushing unit 11.

Further important advantages of the improved apparatus are its simplicity and compactness. This is attributable, at least to a certain extent, to the fact that the rather bulky labelling unit 9 can remain stationary, the same as the brush and the adhesive applying unit 8. Instead, it is merely necessary to change the angular positions of the cams 17, 18 within a relatively small angle beta in order to convert the apparatus for the treatment of containers having circular portions of a particular diameter. These cams have a single rotational program.

In order to achieve higher rotational speeds of supporting elements 14 about their respective axes Y when the improved apparatus is installed in a labelling machine which is to turn out large numbers of labelled containers per unit of time, the means for rotating the supporting elements can further comprise suitable step-up transmissions (not shown) which are interposed between the holders 21 and the respective supporting elements 14.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine for multiple treatment of containers having circular portions with different diameters, transporting apparatus comprising a carrier turnable about a first axis, means for turning said carrier about said axis in a first direction; a succession of container supporting elements mounted on said carrier for orbital movement about said axis along a predetermined path, each of said elements being turnable about a discrete second axis parallel to said first axis; means for treating successive containers at a first portion of said path; means for treating successive containers at a second portion of said path a predetermined distance downstream of said first portion; means for rotating said elements about the respective second axes in a second direction counter to said first direction, including first and second cams adjacent said path and first and second followers provided on each of said elements and respectively tracking said first and second cams; and means for adjusting said cams relative to said path as a function of the diameters of circular portions of containers which are supported by said elements, said adjusting means including means for moving said cams along said path in and counter to said first direction.

2. The apparatus of claim 1, wherein said cams have toothed cam faces and are offset relative to each other in said first direction.

3. The apparatus of claim 2, wherein each of said cam faces has a series of identical sections in the direction of said path and each section of each of said cam faces extends between two spaced-apart points of the respective cam face.

4. The apparatus of claim 3, wherein the treating means at the first portion of said path comprises means for applying an adhesive to circular portions of successive containers in said path.

5. The apparatus of claim 4, wherein the treating means at the second portion of said path comprises means for applying labels to adhesive-coated circular portions of successive containers in said path.

6. The apparatus of claim 3, wherein one of said treating means includes means for coating the circular portions of successive containers with an adhesive and the other of said treating means includes means for applying labels to adhesive-coated portions of successive containers.

7. The apparatus of claim 3, wherein said carrier comprises means for maintaining said elements in suspended positions and said cams are disposed at a level above said elements.

8. The apparatus of claim 7, wherein each of said cams has an arcuate shape and a center of curvature on said first axis.

9. The apparatus of claim 3, wherein said rotating means further comprises a holder on each of said elements, said followers being provided on the respective holders, said points of said cam faces being positioned to maintain said holders in predetermined angular positions relative to the respective second axes in each position of said cams relative to said path when said holders reach said portions of said path.

10. The apparatus of claim 3, wherein said points correspond to predetermined rotational speeds of said supporting elements about the respective second axes in dependency on the diameters of circular portions of the containers which are supported by said elements so that the radially outermost portion of a container advancing past said portions of said path is at a standstill in a predetermined angular position of a holder for the followers on the corresponding supporting element.

11. The apparatus of claim 1, wherein said rotating means comprises holders rotatable with said supporting elements about the respective second axes and supporting the corresponding followers, each of said holders advancing along an entire velocity spectrum for at least one of said cams between the maximum and minimum diameters of the containers intermediate said portions of said path in each position of adjustments of said cams.

12. The apparatus of claim 1, wherein said predetermined distance suffices to permit each of said supporting elements and the roller followers thereon to turn through an angle of 360° about the respective second axis between said portions of said path irrespective of the adjustment of said cams in dependency on the diameters of circular portions of containers which are supported by said elements.

13. In a machine for multiple treatment of containers having circular portions with different diameters, transporting apparatus comprising a carrier turnable about a first axis, means for turning said carrier about said axis in a first direction; a successive of container supporting elements mounted on said carrier for orbital movement about said axis along a predetermined path, each of said elements being turnable about a discrete second axis parallel to said first axis; means for treating successive containers at a first portion of said path; means for treating successive containers at a second portion of said path a predetermined distance downstream of said first portion; means for rotating said elements about the respective second axes in a second direction counter to said first direction, including first and second cams adjacent said path and first and second followers provided on each of said elements and respectively tracking said first and second cams; and means for adjusting said cams relative to said path as a function of the diameters of circular portions of containers which are supported by said elements, said adjusting means including means for moving said cams along said path, said cams having toothed cam faces and being offset relative to each other in said first direction, each of said cam faces having a series of identical sections in a direction of said path and each section of each of said cam faces extending between two spaced-apart points of the respective cam face, said adjusting means including means for moving said cams between an infinite number of different positions through a predetermined angle in and counter to said first direction.

* * * * *